United States Patent [19]

Montgomery

[11] 3,974,929

[45]*Aug. 17, 1976

[54] CHILD RESISTANT CLOSURE

[75] Inventor: Gary Van Montgomery, Evansville, Ind.

[73] Assignee: Sunbeam Plastics Corporation, Evansville, Ind.

[ * ] Notice: The portion of the term of this patent subsequent to July 15, 1992, has been disclaimed.

[22] Filed: June 11, 1975

[21] Appl. No.: 585,782

Related U.S. Application Data

[63] Continuation-in-part of Ser. No. 401,838, Sept. 28, 1973, Pat. No. 3,894,647.

[52] U.S. Cl. ..... 215/216; 215/222; 215/225; 215/256; 215/342

[51] Int. Cl.[2] ..... B65D 55/02; B65D 85/56; A61J 1/00

[58] Field of Search ..... 215/91, 221, 216, 224, 215/225, 222, 254, 256, 342

[56] References Cited

UNITED STATES PATENTS 3,894,647 7/1975 Montgomery ..... 215/221 X

*Primary Examiner*—George T. Hall
*Attorney, Agent, or Firm*—Henry K. Leonard

[57] ABSTRACT

A substantially leak-proof and child-resistant combination closure comprising a container and a cap. The container has a neck and the cap has a tubular skirt which fits over the container neck, a disc-like top and resilient annular shoulder portion. The cap skirt and bottle neck have cooperating means for retaining the cap on the container. There is a sealing liner beneath the top of the cap which engages and seals the open end of the container neck. The cap skirt and the container in some embodiments have cooperating locking means which are engaged when the cap is moved down to normal closed position on the bottle neck. The locking means function to render the closure child-resistant. Other embodiments have tamper indicating means. The resilient shoulder portion of the cap flexes to compensate for tolerance variations in the cooperating retaining means on the cap and container neck in order to insure that the cap liner seals the neck of the container.

10 Claims, 10 Drawing Figures

CHILD RESISTANT CLOSURE

This application is a continuation-in-part of my copending application Ser. No. 401,838, filed Sept. 28, 1973, now U.S. Pat. No. 3,894,647.

BACKGROUND OF THE INVENTION

With the current emphases that has been placed upon protection of children of tender ages from harm due to their being able to open containers of medicines, acids, soaps, etc., development of so called "child-proof" or, more correctly, "child-resistant" containers and closures, has been very rapid.

Many of these child-resistant combinations have employed threaded caps and containers with threaded necks, the caps and containers being provided with cooperating means which function to prevent the child of tender years from removing the cap from the container after it has been seated thereon.

Devices of this type which are practical also must be so designed as to provide for capping the containers by the use of conventional capping equipment. Since many such products previously have been packaged in vials or, glass or plastic bottles with threaded necks and screw-on caps, or with bayonet or snap-on caps most packaging organizations already possess automatic capping machinery which is capable of placing such caps onto the container necks.

However, the tolerances of manufacturing of both the containers and the caps are such that when screw-type caps are put on by automatic capping machines, they do not all reach the same angular position relative to the containers on which they are set by the capping machines. Similarly even bayonet or snap-on caps are not always forced down onto the containers the same distance when they are applied.

If the caps have internal sealing liners which function to render the necks of the containers leak proof, variations in the degree of tightening of the caps onto the necks of the bottles may be important as a result of cumulations in the tolerances. When cork was inexpensive, because it is highly resilient and does not take a "set" if it is squeezed too tightly, it frequently was utilized as the main body of the sealing liners so that it would compensate easily for these variations and would maintain all of the containers in liquid tight condition even if the caps squeezed the liners to differing degrees. However, when other liner materials are used, the liners will take a "set" and may not be replaced by the user to a distance on the container neck such that the liner will keep the container leakproof.

It is the object of the instant invention, therefore, to provide a cap for a container which has a resilient shoulder which compensates for variations in cumulated tolerances to insure that the liner seals the container neck when the cap reaches its closed position on the container neck, particularly when the closed position is predetermined as in the cases of threaded caps having child-resistant means, bayonet-type threads or beveled snap-on retaining means.

These and other more specific object and advantages of a closure embodying the invention will be better understood from the specification and from the drawings which follow.

DESCRIPTION OF PREFERRED EMBODIMENTS

Figure 1:
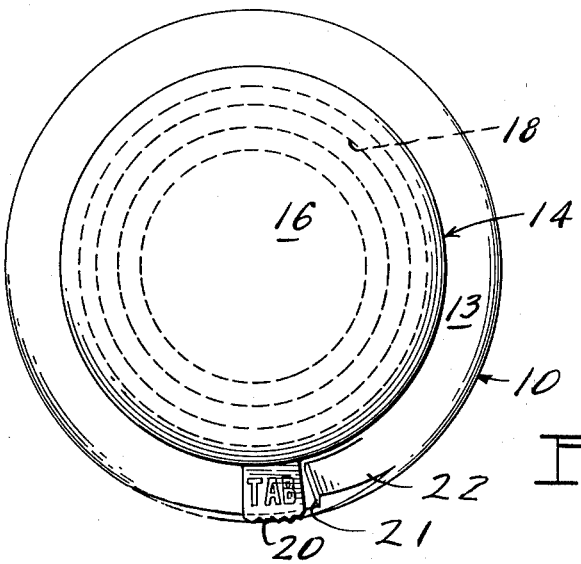
FIG. 1 is a top plan view of a child-resistant closure embodying the invention.

A substantially leak-proof and child-resistant closure combination according to a first embodiment of the invention comprises a container 10 which has a generally cylindrical body portion 11, a threaded neck 12 and an annular shoulder 13 joining the wall of the body 11 to the base of the neck 12.

An inverted cup-shaped cap 14 has a tubular skirt 15, a disc-like top 16 and a resilient annular shoulder portion 17 connecting the disc-like top 16 and the skirt 15. The cap 14 also has threads 18 formed on the inner surface of its skirt 15 to mate with the threads on the neck 12 of the container 10, the threads cooperating as cap retaining means.

A disc-like liner 19 is positioned against the inner side of the cap top 16 and is of such size as to close and seal the open center of the container neck 12.

In this first embodiment of the invention the cap 14 and the container 10 have cooperating child-resistant locking means which consist of a radially outwardly directed tab 20 at the lower edge of the cap skirt 15 and a stop 21 formed on the shoulder 13 of the container to be engaged by the tab 20. When the cap 14 is turned onto the container 10, either in its initial capping or after use, the cap 14 must be rotated a sufficient distance for the tab 20 to ride up an incline 22 on the shoulder 13 of the container 10 and then to snap by its own resiliency downwardly behind the stop 21. This is the closed position of the closure 14 relative to the container neck 12.

If it were possible to manufacture the cap 14 and the container 10 and its threaded neck 12 without any tolerances in the dimensions, the cap 10 and the neck 12 could be maintained at proper sizes so that when the cap 10 is turned to the normal closed position, the liner 19 would be pressed against the open neck 11 with just sufficient force so as to seal the container. Of course all manufactures on a production basis must be made with a definite manufacturing tolerance, say plus or minus .005 inch or the like, so that when these tolerances cumulate if the cap 10 is turned to its normal closed position, the liner 19 may or may not be in its proper sealing adjacency to the end of the container neck 12. If the tolerance cumulate in one direction, the container may not be sealed at all. If the tolerances cumulate in another direction, it may not be possible to turn the cap 14 far enough down onto the neck 12 for the child-resistant locking means comprising the tab 20 and the stop 21 to engage.

It it were economically feasible to utilize natural cork for the liner 19, it would have sufficient resiliency and compressability so that it could be made thick enough to engage the end of the container neck 12 in sealing relationship at both extremes of the tolerance variations. However, as mentioned above, the cost of cork has become prohibitive for its use as a liner in large volume containers such as aspirin bottles, and the like.

Figure 2:
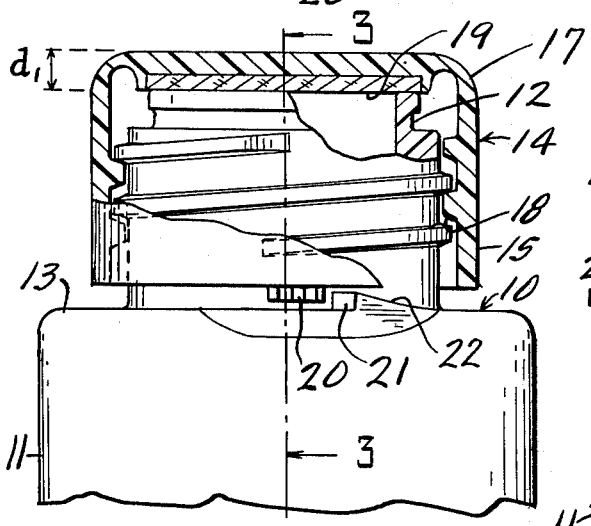
FIG. 2 is a fragmentary view in vertical elevation, with parts broken away of the closure shown in FIG. 1.
Figure 3:
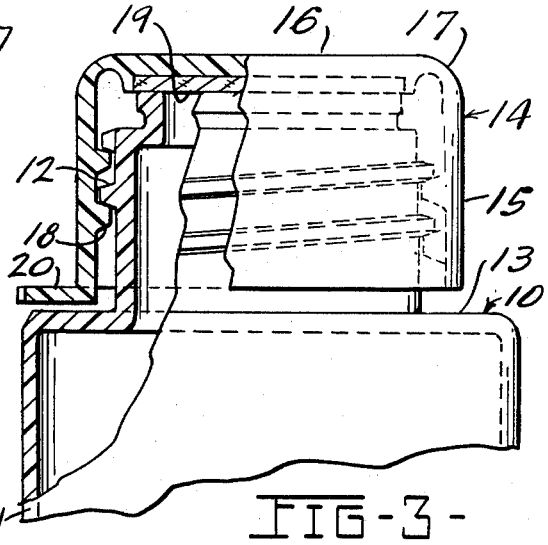
FIG. 3 is a fragmentary, vertical sectional view with parts broken away taken along the line 303 of FIG. 2.
Figure 5:
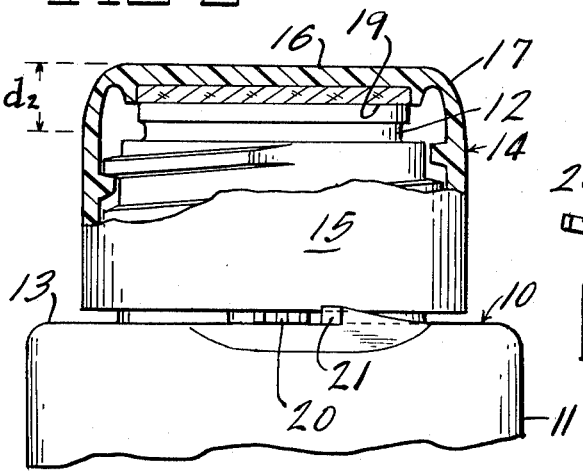
FIG. 5 is a view similar to FIG. 2 and illustrating how the closure of the combination of the invention may be distorted to insure sealing engagement of its liner against the open neck of the container.
Figure 4:
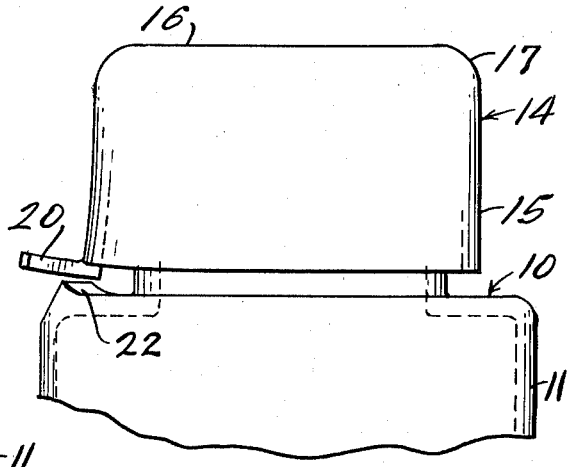
FIG. 4 is a fragmentary side view in elevation showing how the child-resistant locking means of this embodiment is disengaged to permit removal of the cap from the container.

In order to compensate for the tolerance variations, the cap 14 of the invention has the resilient annular shoulder portion 17 so that the liner 19 is brought into sealing engagement with the end of the threaded neck 12 of the container 10 whether the tolerances result in the locking tab 21 reaching the normal position as illustrated in FIG. 2 or as illustrated in FIG. 5. It will be observed by comparing the indicated distances "$d_1$" and "$d_2$", that the extremes of the tolerance variations are illustrated and that in both conditions, the tab 20 is positioned beyond the stop and the liner 19 is pressed against the end of the neck 12. The annular shoulder 17 is illustrated as being stretched downwardly in FIG. 5 to compensate for the tolerance variations presumed to exist between the cap 14 and neck 12 of FIGS. 2 and 5, respectively.

Figure 6:
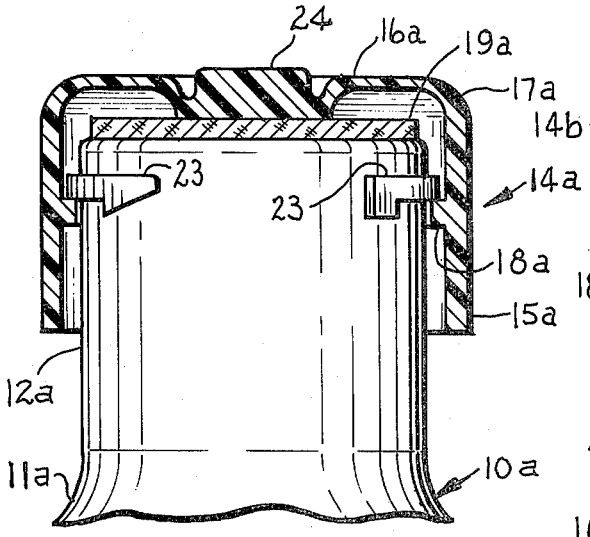
FIG. 6 is a view similar to FIG. 2 illustrating a second embodiment of the invention employing bayonet-type cap retaining means.

A second embodiment of the invention is illustrated in FIG. 6. In this embodiment, a container 10*a* has a body 11*a* and a neck 12*a*. The neck 12*a* has two or more bayonet-type lug threads 23. A cap 14*a* has a skirt 15*a* and a top 16*a*. Like the earlier embodiment of the invention, the cap 14*a* has a resilient shoulder portion 17*a* and has, in place of the threads of the earlier embodiment, a number of inwardly extending lugs 18*a* which cooperate with the lug threads 23 for retaining the cap 14*a* on the bottle 10*a*. A liner 19*a* is positioned against the inner surface of a central pad 24 of the cap top 16*a* and is retained against the open end of the bottle neck 12*a* by the resiliency of the cap shoulders 17*a*. Thus, even through the liner 19*a* may be compressed beyond its ability to restore to its normal thickness when the cap 14*a* is rotated to engage its lugs 18*a* with the lug threads 23, the resiliency of the shoulder portion 17*a* of the cap 14*a* continues to press the liner 19*a* against the end of the neck 12*a* to maintain a liquid tight seal.

Figure 7:
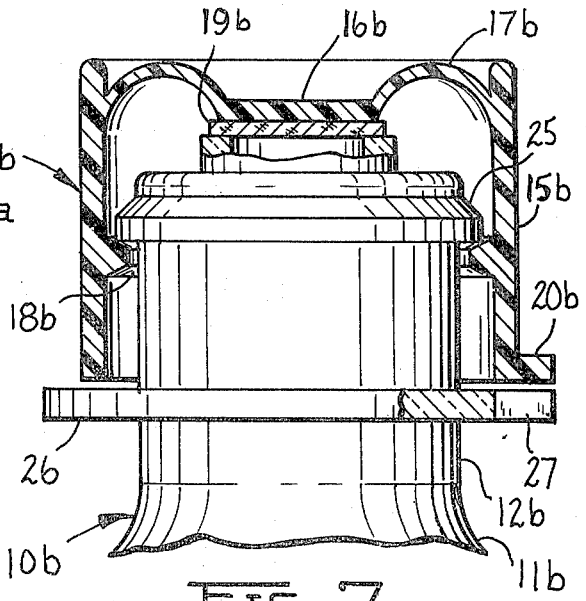
FIG. 7 is a view similar to FIG. 6 illustrating a third embodiment of the invention employing retaining means of the snap-on type and also illustrating a second type of child-resistant means.
Figure 8:
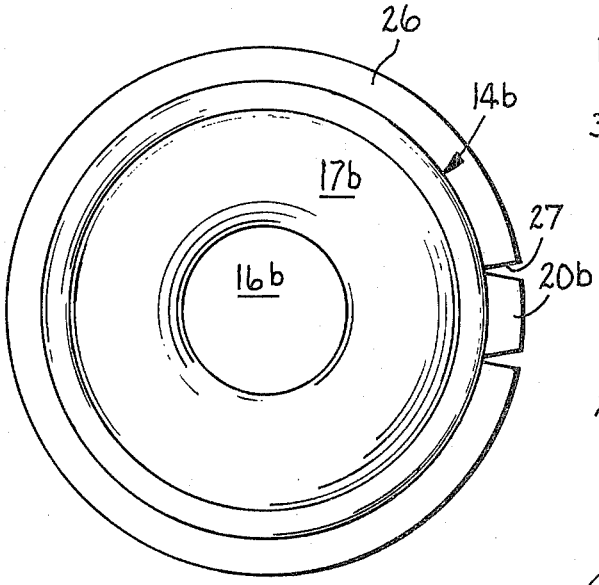
FIG. 8 is a top plan view of the embodiment of the invention illustrated in FIG. 7.

A third embodiment of the invention is illustrated in FIGS. 7 and 8 and includes a child-resistant feature. In this embodiment, a container 10*b* has a body 11*b* and a neck 12*b*. In this embodiment the neck 12*b* has an annular rim 25 near its open end. A cap 14*b* has a skirt 15*b* and a top 16*b* which includes a bellows-like shoulder 17*b*. In this embodiment, the cap retaining means consists of the ring 25 on the bottle neck 12*b* and an inwardly directed snap-ledge 18*b* on the inner side of the cap skirt 15*b*. The ledge 18*b* may be an annular ledge extending entirely around the inner wall of the skirt 15*b* or it may be a number of shorter sector-like elements. In either case, again because of the tolerance variations, the ledge 18*b* may snap in beneath the rim 25 when the cap 14*b* has pushed it downwardly onto the bottle neck 12*b* at varying distances, these variations being compensated by the resiliency of the shoulder 17*b*, thus to maintain a liner 19*b* tightly against the open end of the container neck 12*b* to provide a liquid-tight seal.

This embodiment of the invention also has child-resistant means comprising a radially outwardly extending tab 20*b* at the lower end of the cap skirt 15*b* and a collar 26 formed on the container neck 12*b* at a level just below the level reached by the bottom end of the cap skirt 15*b* when the cap 14*b* is positioned as shown in FIG. 7. The collar 26 has a gap 27 only slightly larger circumferentially than the tab 20*b* so that a person's finger can reach the tab 20*b* to remove the cap 14*b* only after the cap 14*b* has been rotated relative to the neck 12*b* to align the tab 20*b* with the gap 27 as shown in FIG. 8.

Figure 9:
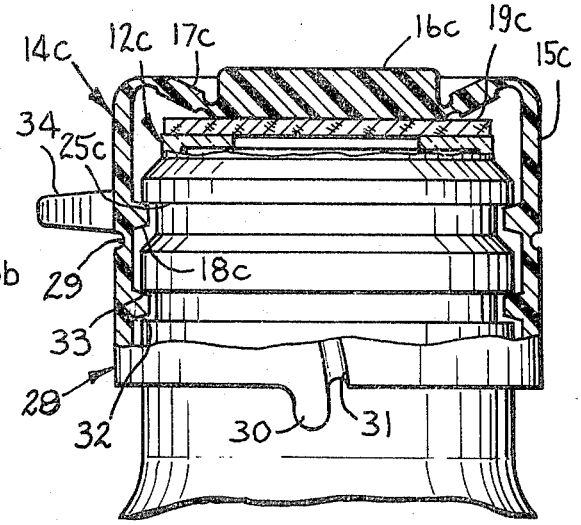
FIG. 9 is a view similar to FIGS. 2, 6, and 7 illustrating a fourth embodiment of the invention employing snap-on retaining means and also provided with a tamper indicating means.
Figure 10:
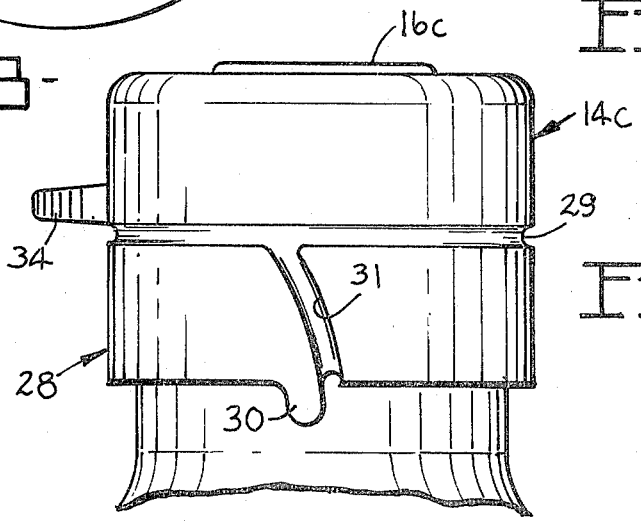
FIG. 10 is a fragmentary enlarged view of a portion of the embodiment illustrated in FIG. 9 showing how the cap is retained on the container neck after the tamper indicating means has been removed.

A fourth embodiment of the invention is illustrated in FIGS. 9 and 10. A cap 14*c* has a skirt 15*c*, a top 16*c* and a resilient shoulder portion 17*c*. A lip 18*c* extends inwardly near the bottom of the skirt 15*c* and engages beneath a rim 25*c* when the cap is in closed position as illustrated in FIG. 9. The resilient shoulder 17*c* compensates for tolerance variations, as in the earlier described embodiments, to maintain a liner 19*c* tightly against the open end of a container neck 12*c*.

A removable skirt extension 28 initially is connected to the lower edge of the skirt 15*c* by a thin, frangible section 29. The removable extension 28 has a downwardly extending ear 30 and a thin tear groove 31 leading up to the frangible section 29. When the cap 14*c* is initially placed on the container neck 12*c*, its lip 18*c* snaps in underneath the rim 25*c* and the presence of the removable ring 28 and its ear 30 is a clear indication that the container has not been opened. If desired, the removable skirt extension 28 may also have an additional lip 32 to engage beneath a second rim 33 on the bottle neck 12*c*. The second lip 32 and rim 33 make it almost impossible to remove the cap 14*c* without first tearing away the skirt extension 28. This is accomplished by the first person who opens the closure grasping the ear 30 between the fingers of one hand, holding a tab 34 on the cap skirt 15*c* with the other hand and tearing away the frangible portion 29. Thereafter the cap of FIGS. 9 and 10 becomes a cap of the type generally called a "snap-on" similar in operation to the cap illustrated in FIG. 7 and the resilient shoulder 17*c* compensates for tolerance variations so that the cap 14*c* continues to keep the container liquid-tight.

Having described my invention I claim:

1. A substantially leak-proof container combination, said combination comprising, a. a container having a tubular neck portion and a body, b. a one-piece cap for said container, said cap having a disc-like top, a tubular skirt and a resilient annular shoulder portion means connecting said skirt and said top, c. circular sealing means on the under side of said cap top and engageable with the end of said container neck for sealing said neck, and d. cooperating retaining means on said container neck and on said cap skirt for retaining said cap on said neck in sealing position, e. said shoulder portion means being stretchable for downward movement of said cap skirt for compensating for tolerance variations in said cooperating retaining means and in the positions of said cooperating retaining means on said container neck and on said cap skirt.

2. A combination according to claim 1 in which the cooperating retaining means comprise outwardly extending means on the container neck and inwardly extending means on the cap skirt.

3. A combination according to claim 2 in which the cooperating retaining means are mating thread elements on the container neck and the cap skirt.

4. A combination according to claim 2 in which the cooperating retaining means consist of lug threads and engaging lugs.

5. A combination according to claim 2 in which the cooperating retaining means are a radially outwardly extending annular rib on the container neck and an inwardly extending annular lip on the cap skirt that is engageable beneath said rib for retaining said cap on said container neck.

6. A combination according to claim 5 and a removable means on the lower end of the cap skirt initially engaged with the rib on the bottle neck for preventing removal of the cap without prior removal of said removable means.

7. A combination according to claim 1 and cooperating child-resistant locking means on the cap skirt and the container neck portion for preventing removal of the cap from the container without comprehensive special actuation of at least one of said cooperating locking means.

8. A combination according to claim 7 in which the cooperating locking means comprises a radially outwardly extending tab at the lower edge of the cap skirt.

9. A combination according to claim 8 in which the cooperating retaining means are mating thread elements and which has a stop on the container shoulder against which the tab engages when the cap is rotated in opening direction from its closed position.

10. A combination according to claim 8 and a radially outwardly extending annular rib on the container neck at a level just beneath the lower edge of the cap skirt, there being a gap in said rib through which the tab may be grasped for removing the cap when the cap and container are relatively rotated for aligning said tab with the gap.

* * * * *